US005620141A

United States Patent [19]

Chiang

[11] Patent Number: 5,620,141

[45] Date of Patent: Apr. 15, 1997

[54] POP-UP ROTARY SPRINKLER

[76] Inventor: Jung-Li Chiang, 930 W. Maude Ave., Sunnyvale, Calif. 94086

[21] Appl. No.: 380,415

[22] Filed: Jan. 30, 1995

[51] Int. Cl.[6] ..... B05B 3/00

[52] U.S. Cl. ..... 239/206; 239/240

[58] Field of Search ..... 239/203, 204, 239/205, 206, 237, 240, DIG. 1, DIG. 12, DIG. 15

[56] References Cited

U.S. PATENT DOCUMENTS

| | | | |
|---|---|---|---|
| 3,404,840 | 10/1968 | Trickey | 239/204 |
| 3,428,256 | 2/1969 | Painter | 239/240 X |
| 3,712,545 | 1/1973 | Felix | 239/240 X |
| 4,353,506 | 10/1982 | Hayes | 239/206 |
| 4,781,327 | 11/1988 | Lawson et al. | 239/203 |

*Primary Examiner*—Josie Ballato

[57] ABSTRACT

A sprinkler (10) includes a tubular housing (12) and a cover (14) fastened with each other. A smaller internal sleeve (70) has a similar configuration with the housing (12) and is generally positioned within the housing (12). The sleeve (70) includes a plurality of inlets (82) in the wall. A rotor (40) having radial blades (48) positioned circumferentially at intervals, is disposed in the sleeve (70) and is adapted to be impacted to rotate by the flow from the inlets (82) of the sleeve (70). A hollow spindle (52) which can be slidably moved along the axis of the rotor (40), is designedly actuated by the rotary movement of the rotor (40) and also generally in a synchronous rotation with the rotor (40). Such spindle (52) can be pushed by the water pressure to have the nozzle head (54) extend upward and exposed in an exterior for water dispersal.

7 Claims, 4 Drawing Sheets

POP-UP ROTARY SPRINKLER

BACKGROUND OF THE INVENTION

1. Field of the Invention

The invention relates to lawn sprinklers, particularly to riser rotary sprinklers having simplified structures and satisfied spraying effects in the low flow rate.

2. The Prior Art

The conventional rotary or oscillatory lawn sprinklers include the plastic vertical type as shown in U.S. Pat. Nos. 4,898,332, 4,944,456, 4,957,240, 4,967,961, 4,986,474, 5,007,586, 5,148,990, 5,226,602 and 5,297,737, and the metal slanted type as shown in U.S. Pat. Nos. 4,907,472, 4,964,572, 4,978,070, 5,090,621, 5,209,404, 5,238,188 and 5,267,689, wherein some of the plastic type can further include a pop-up structure of a hidden nozzle head when such sprinklers are in an inoperative state. For example, in U.S. Pat. No. 5,297,737 having a plastic vertical type mechanism, a portion of the stream is redirected by a pivot deflecting plate for radially spraying. In such situation, the initiative stream should be strong enough not to fail to impel such pivot plate, whereas such strong stream results in big beads of the bounced jet from the deflecting plate and that is not desired by the original intention which requires dense fine beads uniformly dispersed. On the other hand, most metal type sprinklers are generally in the form of oscillation operation, and thus have complicated mechanisms and the corresponding higher cost. A metal type sprinkler further is possibly eroded over long term use.

Therefore, an object of the invention is to provide a rotary sprinkler which has a simpler structure and a lower cost, and also performs a uniform dispensation of the water jet even though it is in a low flow rate condition.

Another object of the invention is to provide a rotary sprinkler with a riser nozzle head for easy maintenance of the lawn field when such sprinkler is in the inoperative state.

A further object of the invention is to provide a rotary sprinkler with adjustable mechanism for controlling the water jet dispersed out of the nozzle head.

SUMMARY OF THE INVENTION

According to an aspect of the invention, a sprinkler includes a tubular housing and a cover fastened with each other. An less dimensioned internal sleeve has a similar configuration with the housing and is generally positioned within the housing. The sleeve includes a plurality of inlets in the wall. A rotor having radial blades positioned circumferentially at intervals, is disposed in the sleeve and is adapted to be impacted to rotate by the flow from the inlets of the sleeve. A hollow spindle which can be slidably moved along the axis of the rotor, is designedly actuated by the rotary movement of the rotor and also in an expected synchronous rotation with the rotor. Such spindle can be pushed by the water pressure to have the nozzle head extend upward and exposed in an exterior for water dispersal.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
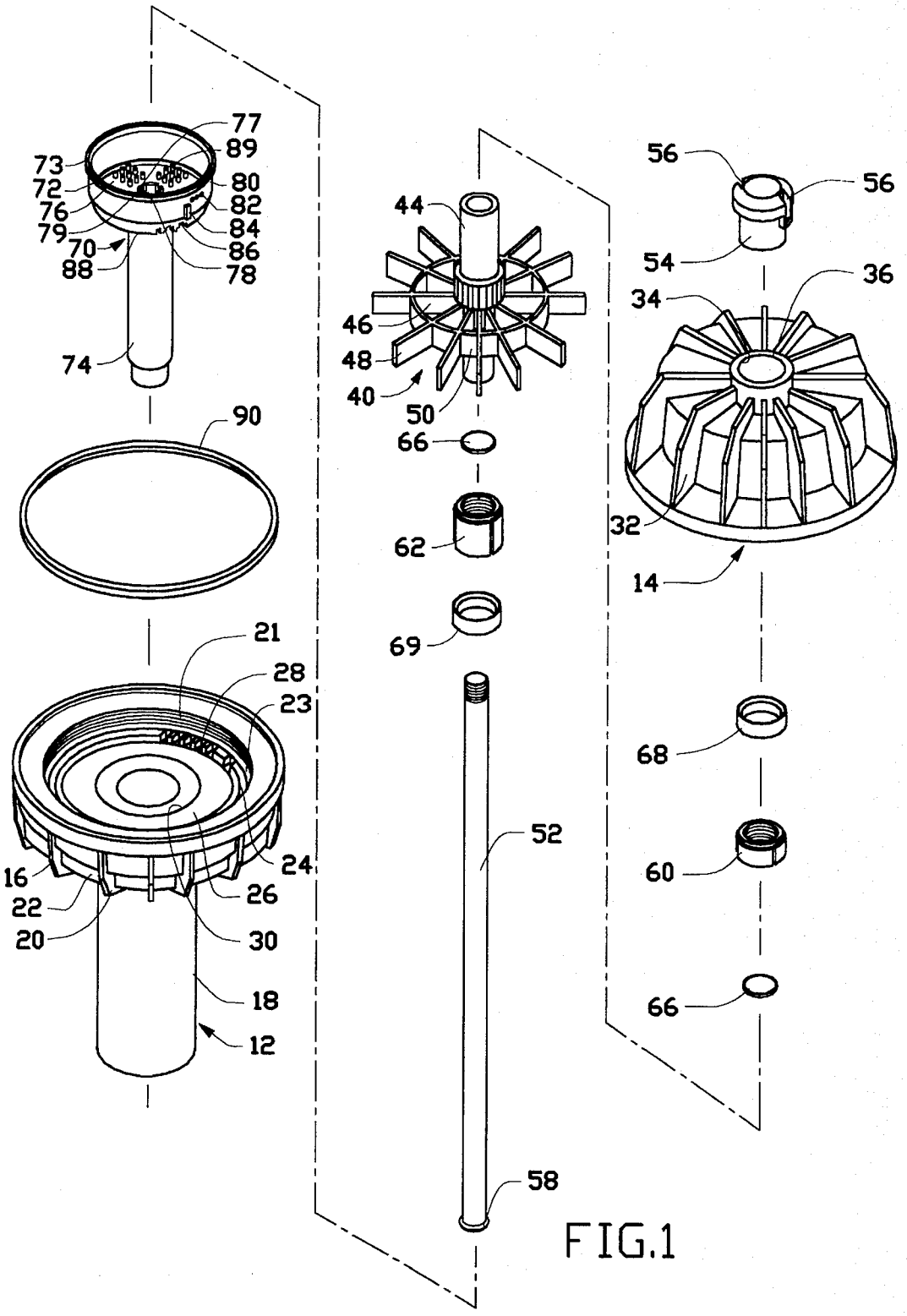
FIG. 1 is an exploded perspective view of a sprinkler of a preferred embodiment according to the present invention.

It will be noted here that for a better understanding, most of like components are designated by like reference numerals throughout the various figures in the embodiments. Attention is now directed to both FIGS. 1 and 2 wherein a sprinkler 10 is composed of a housing 12 and a cover 14 fastened to each other. The housing 12 includes a pan-like portion 16 and a cylinder portion 18 integrally extending downward therefrom wherein the bottom end of the cylinder portion 18 can be communicably fastened to a pipe connector 100 (FIG. 2) in a sprinkler system (not shown), and the top end of the cylinder portion 18 is communicable with the interior of the pan-like portion 16.

The pan-like portion 16 has a plurality of reinforcement ribs 20 surrounding the circumferential wall 22 thereof, and a ring-like protrusion 24 extending upwardly from the bottom plate 26 of such pan-like portion 18, in which a plurality of notches 28 are disposed for cooperation with another set of notches 86 in an internal sleeve 70 which will be described in detail later. Internal threads 21 are provided with the inner surface 23 of the circumferential wall 22 to cooperate with external threads 35 (FIG. 2) on the cover 14 for assembling the housing 12 and the cover 14 together. A through hole 30 is positioned substantially at the center of the bottom plate 26 of the pan-like portion 16, thus allowing the communication between the interior of the pan-like portion 16 and that of the cylinder portion 18 as mentioned before.

The cover 14 is of an upside-down pan-like configuration and has generally a similar radial dimension with the pan-like portion 16 of the housing 12. Similar to the pan-like portion 16 of the housing 12, the cover 14 includes a plurality of circumferential reinforcement ribs 32 on its external surface, and a through hole 34 within a bearing section 36 at the top thereof for allowing a spindle upward extend therethrough and which will be described in detail later. External threads 35 are provided on the external surface 31 of the circumferential wall 33 (see FIG. 2) to cooperate with the internal threads 21 of the housing 12 for fastening the housing 12 and the cover 14 together.

A rotor 40 generally positioned in a space 42 (FIG. 2) defined between the cover 14 and the housing 12, includes a tubular axle 44 and a turbine wheel 46 integrally positioned at the bottom end of the tubular axle 44 wherein such wheel 46 is composed of a plurality of blades 48 radially, in equal intervals, extending outwardly from a center point which is aligned with the axis of such tubular axle 44. A reinforcement ring-like rib 50 defines a half radius circle in comparison with the full length of the blade 48, so as to such ring-like rib 50 and the corresponding blades 48 intercept with each other. Therefore, the blades 48 and the ring-like rib 50 are formed as a one piece having a great strength to be rotatably actuated by the water flow.

An elongated tubular spindle 52 is adapted to be coaxially inserted into the axle 44 of the rotor 40 wherein such spindle 52 is not only slidable along the axis of the rotor 40, but also co-rotated with the rotor 40. A nozzle head 54 is attached, via threads, to the top of the spindle 52 and hidden in the bearing section 36 of the cover 14 in an inoperative status. The nozzle head 54 has two diametrically opposite outlets 56 helically extending outwardly with regard to the axis of the spindle 52. A ring-like stopper 58 is positioned at the bottom of the spindle 52, which defines the limit of upward slidable axial movement of the spindle 52 with regard to the housing 12 and/or the cover 14. Bearing rings 60, 62, sealing O-rings 64, 66 and grease packings 68, 69 are installed in pairs surrounding the spindle 52 for allowing such spindle 52 to be rotated and slidable with regard to the housing 12 and the cover 14.

A sleeve 70 has generally the similar but smaller configuration with the housing 12 so that such sleeve 70 is adapted to be received within the housing 12. The sleeve 70 includes a bowl-like section 72 and a cylinder section 74 extending downward from the bottom plate 76 of the bowl-like section 72 wherein the bottom end of such cylinder section 74 is of a closed type but the top end thereof is open to communicate with the interior of the bowl-like section 72 via a hole 78 substantially positioned at the center of the bottom plate 76 of the bowl-like section 72. A support rim section 79 is substantially integrally positioned on the bottom plate 76 surrounding such hole 78 wherein a plurality of slots 77 radially extend therethrough in equal intervals so that the water in the bowl-like section 72 can enter the interior of the cylinder section 74 via such slots 77.

The bowl-like section 72 includes a circumferential wall 80 having inlets 82 therein for transferring the water from the exterior to the interior of the sleeve 70 wherein each inlet 82 is designedly formed in the same helical status with the outlet 56 of the nozzle head 54. There are blocks 84 and on the external surface of the wall 80 and notches 86 on the undersurface 88 of the bottom plate 76 in the bowl-like section 72, which both cooperate with the aforementioned notches 28 of the ring-like protrusion 24 of the housing 12 for controlling the flow rate and/or the water pressure in the sleeve 70. There are a plurality of small posts 89 formed on the bottom plate 76 of the bowl-like section 72, of which the dimensions are conformable to those of the inlets 82 in the wall 80. Therefore, the user can further optionally and selectively cut off some posts 88 from the bottom plate 76 and insert such detached posts 88 into some of the inlets 82 to block some of the inlet 82 for minimizing the flow rate.

Figure 2:
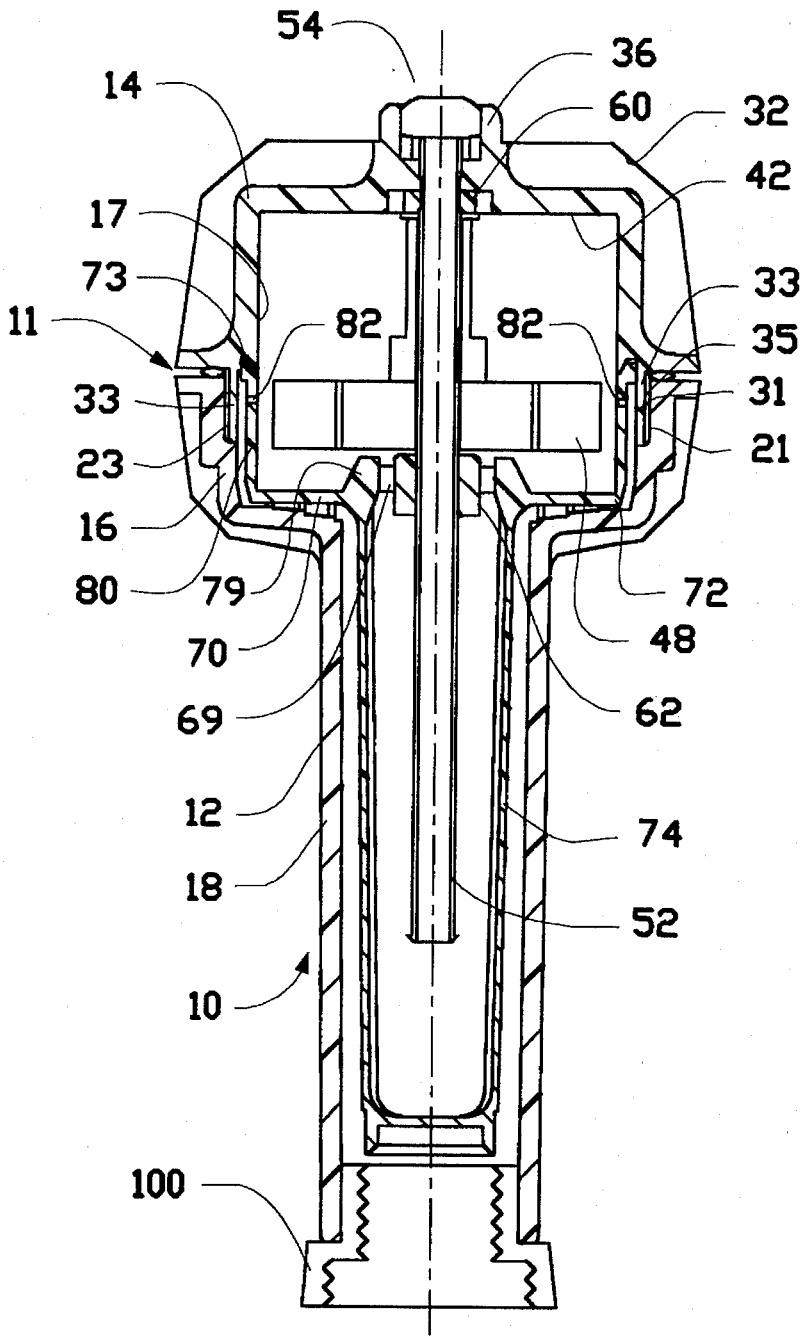
FIG. 2 is a cross-sectional view of the sprinkler of FIG. 1 in an inoperative state.

As shown in FIG. 2, when assembled, the housing 12 and the cover 14 can be fastened to each other, via the engagement of the internal threads 21 of the housing 12 and the external threads 35 of the cover 12, with sandwiching a sealing O-ring 90 therebetween. Such assembly 11 of the housing 12 and the cover 14 can be attachably threaded to a connector member 100 below (a portion shown) in a sprinkler system (not shown in FIG. 2). The internal sleeve 70 is substantially received within the interior of the housing 12 in position wherein the top edge portion 73 of the circumferential wall 80 is pressed by the inner rim portion 17 of the cover 14 so that the internal sleeve 70 has both radial and axial securements within the assembly 11. The rotor 40 is properly positioned in the space 42 in the assembly 11, which is restricted by the corresponding bearing rings 60, 62 from moving in the axial direction, wherein the lower bearing ring 62 and the grease packing 69 are concentrically fastened within the support rim section 79 of the internal sleeve 70. The spindle 52 is coaxially received in the rotor 40 wherein the lower portion of the spindle 52 can be positioned within the interior of the internal sleeve 70 and the nozzle head 54 can be embedded within the bearing section 36 of the cover 14.

Figure 3:
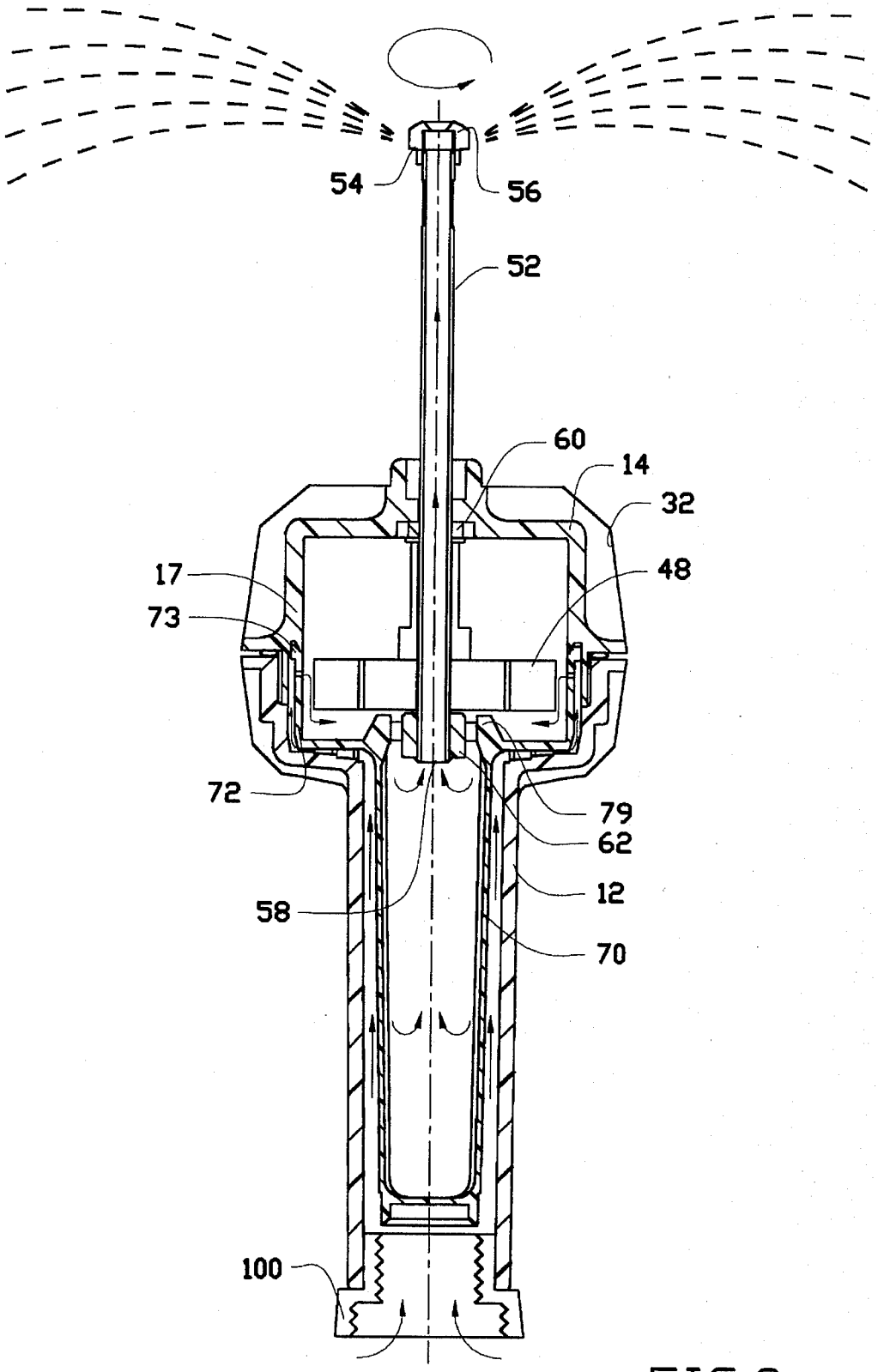
FIG. 3 is a cross-sectional view of the sprinkler of FIG. 1 in an operative state showing the water path.

As shown in FIG. 3, when water comes out from the connector member 100, it passes from the bottom portion into the space between the housing 12 and the internal sleeve 70. Such flow successively passes the spaces defined by the notches 28 (FIG. 1) of the housing 12 and the notches 86 of the internal, sleeve 70, and enters the interior of the internal sleeve 70 via the inlets 82 in the bowl-like section 72. The water fills the interior of the bowl-like section 72 of the internal sleeve 70, and successively, through the slots 77 about the opening 78 (FIG. 1), enters the interior of the cylinder section 74 thereof, and then naturally invades the interior of the spindle 52 for attempting to escape into the outside via the outlets 56 positioned in the nozzle head 54 at the top of the spindle 52. Understandably, the water pressure naturally and mechanically lifts upwards the spindle 52 until the stopper 58 of the spindle 52 confronts the lower edge of the lower bearing ring 62. In this situation, the nozzle head 54 can extend a distance upward into the air to reach a longer range of watering.

It can be appreciated that the flow entering the interior of the bowl-like section 72 of the internal sleeve 70 and actuates the rotor 40 to be rotated about the spindle 52. Understandably, the clearance between the rotor 40 and the spindle 52 should not only be large enough to let the spindle 52 be able to slide up and down along the axial direction with regard to the rotor 40 during the beginning and the end periods of sprinkling due to the water pressure being under the average, but also be small enough to have sufficient intervening occurring between the spindle 52 and the rotor 40 for co-rotation of the spindle 52 with the rotor 40 during the regular sprinkling period due to the regular water pressure pressing the rotor 40 and the spindle 52 and reducing the clearance therebetween. Anyhow, the spiral configuration of the outlet 56 in the nozzle head 54 also provides reactive rotation of the spindle 52 to such water jet which is discharged therefrom. Thus, the field around such sprinkler can be irrigated uniformly.

Figure 4:
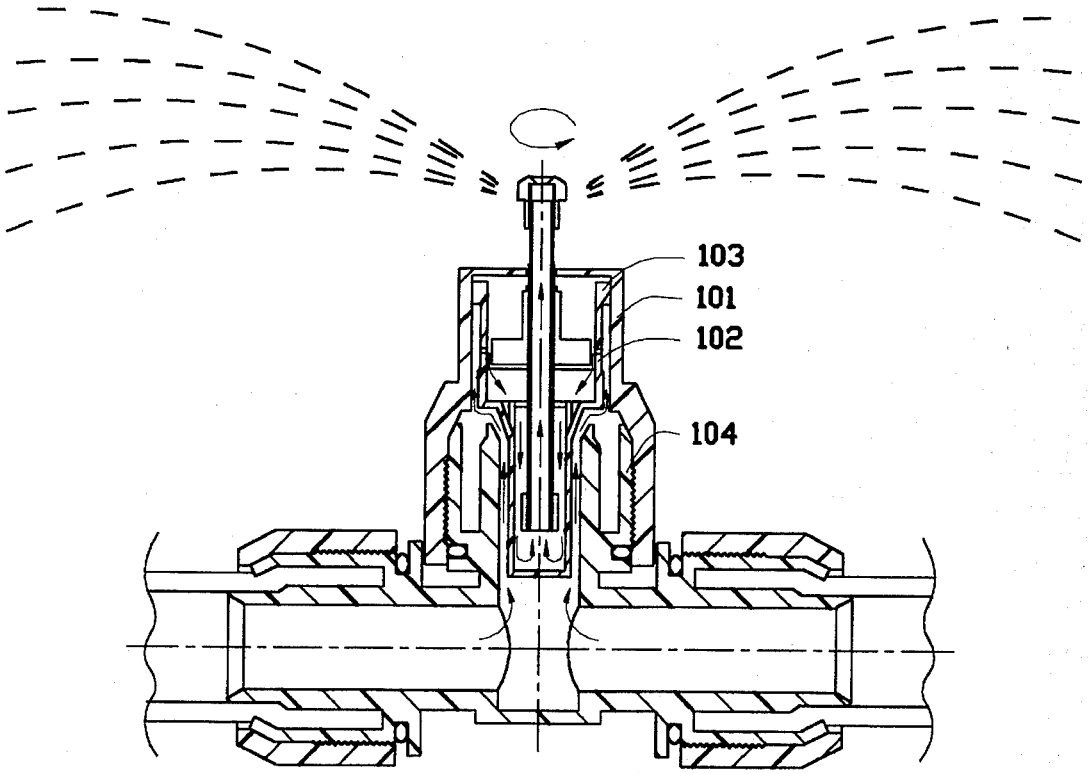
FIG. 4 is a cross-sectional view of another embodiment of the sprinkler for use with a sprinkler system.

FIG. 4 shows another embodiment wherein the cover and the housing is formed integrally as a unit 101 of which the top end can be sealably assembled to the top 103 of the internal sleeve 102 and the bottom end can be, via threads, hermetically assembled to the connection unit 104 on a sprinkler system.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A pop-up rotary sprinkler for use with a sprinkler system, comprising:

a housing and a cover fastened to each other and formed as one assembly;

said housing including a pan-like portion, and a cylinder portion integrally extending downward from said pan-like portion wherein a bottom end of said cylinder portion can be communicably fastened to a pipe connector in said sprinkler system, and a top end of said cylinder portion can be communicable with an interior of said pan-like portion;

an internal sleeve being generally of a similar but less dimensioned configuration with regard to the housing and adapted to be received within the housing, said sleeve including a bowl-like section and a cylinder section extending downward from a bottom plate of the bowl-like section wherein a bottom end of said cylinder section is of a closed type but a top end thereof is open to communicate with an interior of the bowl-like section via a hole positioned substantially at a center portion of said bottom plate of the bowl-like section;

a rotor generally positioned in a space defined between the cover and the housing, said rotor including a tubular axle and a turbine wheel;

an elongated tubular spindle being adapted to be coaxially inserted into the axle of the rotor wherein said spindle is not only slidable along the axis of the rotor, but also co-rotated with the rotor; and a nozzle head is attached to a top portion of said spindle.

2. The sprinkler as defined in claim 1, wherein a plurality of inlets are formed in the bowl-like section of the sleeve and a plurality of outlets are formed in the nozzle head, and said inlets and outlets are both in a form of spiral with regard to said spindle.

3. The sprinkler as defined in claim 1, wherein said internal sleeve further includes a support rim section around said hole at the top of the cylinder section thereof, and a plurality of slots radially extend through said support rim section for passage of water.

4. The sprinkler as defined in claim 1, wherein a plurality of first notches are formed in the pan-like portion of the housing and a plurality of second notches are formed on an undersurface of the bottom plate of the internal sleeve, so that the first notches in the housing and the second notches in the internal sleeve can cooperate with each other for water rate control.

5. A sprinkler comprising:

a housing and a cover fastened to each other for forming as one assembly and defining a first space therein;

an internal sleeve fixedly retained in said first space;

a tubular spindle being adapted to be slidably rotated with regard to the assembly;

a nozzle head positioned at a top portion of said spindle;

a rotor adequately disposed within a second space formed by said cover and said internal sleeve, said rotor being adapted to be freely rotatable with regard to said assembly but without axial movement thereto; and a plurality of inlets positioned in the internal sleeve and a plurality of outlets positioned in the nozzle head whereby a water passage is formed to include a third space between the internal sleeve and the housing, said inlets in the internal sleeve, said second space, an interior of said tubular spindle, and said outlets in the nozzle head; wherein said inlets and said outlets are both of a spiral form.

6. The sprinkler as defined in claim 5, wherein said cover and said housing are integrally formed by molding.

7. The sprinkler as defined in claim 5, wherein said housing includes a pan-like portion and a cylinder portion, and said internal sleeve includes a bowl-like section and a cylinder section.

* * * * *